US009872121B1

(12) United States Patent
Xu et al.

(10) Patent No.: US 9,872,121 B1
(45) Date of Patent: Jan. 16, 2018

(54) METHOD AND SYSTEM OF PROCESSING 5.1-CHANNEL SIGNALS FOR STEREO REPLAY USING BINAURAL CORNER IMPULSE RESPONSE

(71) Applicants: Ren Xu, Guangzhou (CN); Litang Gu, Guangzhou (CN)

(72) Inventors: Ren Xu, Guangzhou (CN); Litang Gu, Guangzhou (CN)

(73) Assignee: WATA Electronics Co., LTD, Zhongshan, Guangdong (CN)

( * ) Notice: Subject to any disclaimer, the term of this patent is extended or adjusted under 35 U.S.C. 154(b) by 0 days.

(21) Appl. No.: 15/591,283

(22) Filed: May 10, 2017

(51) Int. Cl.
*H04S 7/00* (2006.01)
*H04R 3/14* (2006.01)
*H04S 3/00* (2006.01)

(52) U.S. Cl.
CPC ..... *H04S 7/303* (2013.01); *H04R 3/14* (2013.01); *H04S 3/008* (2013.01); *H04S 2400/01* (2013.01); *H04S 2400/03* (2013.01); *H04S 2420/01* (2013.01)

(58) Field of Classification Search
CPC ..... H04R 25/505; H04R 2225/43; H04R 25/353; H04S 2400/11; H04S 7/303; H04S 2400/01; H04S 2400/03; H04S 2400/13; H04S 2420/01; H04S 3/008; H04S 3/02; H04S 7/30; H04S 7/301; H04S 7/308
See application file for complete search history.

(56) References Cited

U.S. PATENT DOCUMENTS 8,638,954 B2 * 1/2014 Aoki ..... G10H 1/383 381/102
8,868,414 B2 * 10/2014 Aoki ..... H03G 7/002 381/106
2006/0018493 A1 * 1/2006 Oh ..... H03G 3/301 381/107
2009/0016547 A1 * 1/2009 Aoki ..... H03G 3/02 381/107

* cited by examiner

*Primary Examiner* — Mohammad Islam
(74) *Attorney, Agent, or Firm* — Jie Tan; JT Law Services, PC

(57) ABSTRACT

A down-mixing method of 5.1 audio input channels for two channel replay by DRC processing of the LFE and the LS and RS channel signal before mixing, and by filtering LS and RS channels with BRTFs measured from placing a loud speaker at a corner of a room and measuring head at the diagonal corner of the room.

24 Claims, 9 Drawing Sheets

METHOD AND SYSTEM OF PROCESSING 5.1-CHANNEL SIGNALS FOR STEREO REPLAY USING BINAURAL CORNER IMPULSE RESPONSE

CROSS-REFERENCE

Priority is claimed from the U.S. Provisional Patent Application No. 62/240,396, filed on Oct. 4, 2016, entitled "A Method of Processing 5.1-Channel for Stereo Replay Using Binaural Corner Impulse Response," the entirety of which is hereby incorporated by reference.

DESCRIPTION OF RELATED ART

The present application relates to stereo or 2-channel audio processing; and more particularly, to a method for mixing 5.1 channel audio signals into stereo or 2-channels speaker playback surround sound signals using binaural corner impulse responses (BCIR) as filter in order to obtain better surround sound and audio quality.

Note that the points discussed below may reflect the hindsight gained from the disclosed inventions, and are not necessarily admitted to be prior art.

Human beings perceive sounds with distance and spatial feelings based on multiplicity of cues in the sounds that include level and time differences received by the two ears. The direction-dependent and frequency-response effects are caused by sound reflection in the outer ear, head, torso, walls and environment. Much studies and efforts have been made in reproducing these effects into audio signals in generating binaural audios. Binaural audios consist of reproducing at the entrance of each the listener's ear canals the sound pressure signals containing the proper interaural time difference (ITD) and interaural level difference (ILD) cues required for the listener to perceive a realistic 3D sound image or sound-field. In its most common implementation, binaural audio relies on recording sound with microphones implanted in the ear canals of an artificial human head or equivalently, numerically convolving digital audio with a head-related transfer function (HRTF) representing the listener's head, then playing back the recorded stereo signals at or near the listener's ear canal entrances through earphones or headphones. HRTF filtered digital sounds provide interaural time difference (ITD) and interaural level difference (ILD) cues to listeners' left and right ears, allowing listeners to perceive sounds with distance and spatial feelings without being in such an environment.

On the other hand, the use of 5.1 channel playback audio systems has provided great enrichment for sound experience, in which 5 full bandwidth channels and one low-frequency effect channel projects into 5 speakers and a subwoofer to produce the sounds with which entertainment can be enjoyed more fully. The playback speakers include a front left (FL), a central (C), a front right (FR), a left surround (LS), a right surround (RS) and a subwoofer (LFE), the configuration and positioning of the speakers are, however, complicated and very expensive. Much effort have been made to simplify the multi-channel playback systems by down-mixing 5.1 channel audio signals into two-channel sounds so that listeners with two speaker systems or headphones can receive similar spatial and dimensional effects as those of multichannel systems.

Down-mixing is the audio process of converting audio signals from multiple-channel input into an output of audio signals using fewer channels. Audio mixing of 5.1 channel audio is a complicated task that utilizes multiple functions in order to create a distinct and clear stereo sound. Typically, surround sound channels (LS and RS) are blended with the stereo left and right channels (FL and FR), the center channel (C) is blended equally with the left and right channels, and the LFE channel is either mixed with the front channels or removed completely, during which digital faders are used to attenuate or boost the audio levels of one or several particular channels, whereas, equalizers alter the frequency response of the audio sound to affect the tones of the different frequencies. Down-mixing is conducted in many of today's electronics, such as DVD players or headsets. Programs as MPEGs and DOLBY Digital decoders may be used to conduct the proper automatic filtering and equalization in order to produce a stereo sound from multiple channels with minimal distortions.

While great effort has been focused on minimizing distortion during down-mixing. Additional efforts have been made to improve the feelings of the audio sound as well. HRTFs filters have been built to render sense of space and dimensional image to listeners. HRTFs are obtained through measuring the impulse responses at the left ear and the right ear. Conventionally in order to simplify HRTFs computation, measurements are usually undertaken in an anechoic chamber or in a reflective room to avoid the influence of the environment. However, HRTFs measured in an anechoic chamber do not completely reflect a real hearing experience such as at a concert or in a normal room condition. Audio signals processed with such HRTF filters do not provide the same distance and spatial feelings as when listeners hear in a home or in a normal and non-anechoic chamber surrounding.

Instead of an anechoic chamber, recently researchers have started to use binaural room transfer functions (BRTFs) by measuring binaural room impulse responses (BRIRs) in order to simulate a real room sound listening experience. The reverberations of the sounds are produced when a sound is reflected off of a surface, such as a wall, furniture, or even air. Reverberation improves realism. The amount of reverberation can be used for the construction of the effects of environment of concert halls so that they produce the best acoustics within the occupied space. The impulse responses collected in a normal room are thus processed to simulate the reverberation of sound within the room location.

However, there are many different types of reverberations and the response time is also generally increased, BRTFs computations are much more complicated. Anechoic head-related transfer functions (HRTFs) vary relatively smoothly with frequency in both phase and magnitude, while BRTFs vary from frequency to frequency that reflect the complex interactions between the direct sound and reflected energy that arise in a room. This complexity is reflected in the frequency to frequency fluctuations in both the BRTF magnitude and phase. To simulate such complexity by building a BRTF filter in audio signal processing requires high processing power, the usual DSP (digital signal processor) chips are generally incapable of handling such computation.

As such, there is a great need for solutions for building BRTF type of digital filters with the common types of DSP chips as well as an improved method for down-mixing 5.1 audio channel signals for stereo playback.

SUMMARY

The present application discloses a method of down-mixing audio signals of 5.1 channels into stereo channels with an enhancement in subwoofer signals and binaural processing using DSP chips.

In one embodiment, input audio signals from front left (FL), a central (C), a front right (FR), a left surround (LS), a right surround (RS) and a subwoofer channels are mixed for binaural playback wherein power of the subwoofer signals are not reduced but are downward dynamic compression (DRC) processed before mixing for double channel stereo play back.

In one embodiment, input audio signals from front left (FL), a central (C), a front right (FR), a left surround (LS), a right surround (RS) and a subwoofer channels are mixed for binaural playback wherein the powers of the left surround (LS) and the right surround (RS) are first enhanced and then the enhanced signals are downward dynamic compression (DRC) processed before mixing for double channel stereo playback.

In another embodiment, binaural audio signals are processed using binaural room transfer functions (BRTFs) as a filter wherein binaural corner impulse responses (BCIR) is obtained to build the filter in order to produce sounds having better realism and spatial distance perception.

In one embodiment, the binaural corner impulse responses (BCIR) are measured in a room of the size 5 m×3 m×3 m and by placing an artificial human head with microphones implanted in the ear canals at one corner of the room and placing a loudspeaker at the diagonal corner of the room where the two corners are diagonal to each other, and the left rear or the right rear side of the head faces to the speaker.

In another embodiment, binaural room transfer functions (BRTFs) are obtained by cutting off the initial 14.1 mini-seconds of the response time and by collecting the first 1024 sample taps after the 14.1 mini-seconds of cutting off time-window and by Fourier transform processing of the impulse response taps.

In another embodiment, the filtering processing is performed by using ADAU1701 DSP chip of Analog Devices, Inc (ADI).

BRIEF DESCRIPTION OF THE DRAWINGS

The disclosed application will be described with reference to the accompanying drawings, which show important sample embodiments of the invention and which are incorporated in the specification hereof by reference, wherein.

DETAILED DESCRIPTION OF SAMPLE EMBODIMENTS

Figure 1:
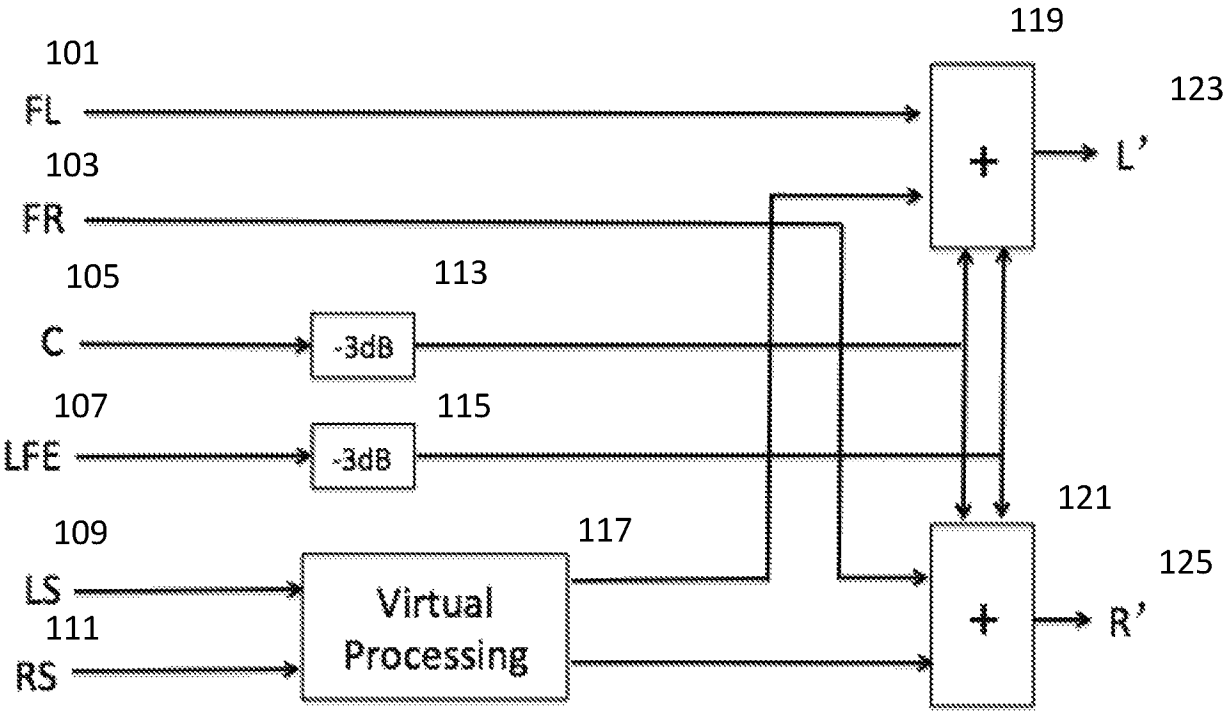
FIG. 1 illustrates the most commonly used process of down-mixing 5.1 channel audio signals into binaural audio signals for two channel playback.

The numerous innovative teachings of the present application will be described with particular reference to presently preferred embodiments (by way of example, and not of limitation). The present application describes several embodiments, and none of the statements below should be taken as limiting the claims generally.

For simplicity and clarity of illustration, the following figures illustrate the general manner of construction, and description and details of well-known features and techniques that may be omitted to avoid unnecessarily obscuring the invention. Additionally, elements in the figures are not necessarily drawn to scale; some areas or elements may be expanded to help improve understanding of the embodiments of the invention.

The terms "first," "second," "third," "fourth," and the like in the description and the claims, if any, may be used for distinguishing between similar elements and not necessarily for describing a particular sequential or chronological order. It is to be understood that the terms used are interchangeable. Furthermore, the terms "comprise," "include," "have," and any variations thereof, are intended to cover non-exclusive inclusions, such that a process, method, article, apparatus, or composition that comprises a list of elements is not necessarily limited to those elements, but may include other elements not expressly listed or inherent to such process, method, article, apparatus, or composition.

The term "5.1 channel audio signals" refer to audio signals for playbacks from different directions including audio signals for playbacks at a front left (FL), a central (C), a front right (FR), a left surround (LS), a right surround (RS) and a subwoofer channels.

The term "down-mixing" refers to the layback process of audio sound signals for multiple channels, such as 5.1 channel audio, into a playback system of less channels.

The term "impulse response" refers to the measurement in which there is a reaction from a person or system in response to an external sound source. They give the acoustic characteristics of a location. The measurements collected can be processed in order to simulate the reverberation of the sound within the location.

The term "reverberation" refers to the persistence of sound after it is produced. A reverb is produced when a sound is reflected off of a surface, such as a wall, furniture, or even air. The amount of reverberation can be used for the construction of concert halls in order to produce the best acoustics within the occupied space.

The term "head related transfer function (HRTF)" refers to a frequency dependent response that characterizes how an ear receives a sound from a point in space. As sound strikes the listener, the size and shape of the head, ears, ear canal, density of the head, size and shape of nasal and oral cavities, all transform the sound and affect how it is perceived, boosting some frequencies and attenuating others. HRTFs are measured under anechoic conditions on human or artificial or artificial heads with small microphones in the ear canal. HRTFs are strongly dependent on direction but also on the head and ear shape. If acoustic transfer functions are measured in an echoic room, i.e. in the presence of reflections and reverberation, they are referred to as binaural room transfer functions (BRTFs).

The term "binaural rendering" refers to the process that makes use of the knowledge of transfer functions between sound sources and the listener's ear signals to create virtual sound sources which are placed around the listener. This process involves convolving a monophonic sound signal with a pair of HTRFs or BRTFs to produce ear signals so that the output audio signals can be played at the ear as if they are played in a real room. Through HTRFs or BRTFs, the important cues for spatial hearing are conveyed and users are able to localize sounds in direction and distance and to perceive envelopment, sounds appear to originate somewhere outside the listener's head as opposed to the in-head localization with a conventional stereo headphone reproduction. The quality of binaural rendering is mostly determined by the localization performance, front-back discrimination, externalization and perceived sound coloration.

The term "binaural replay signals of 5.1-channel" refers to a method of signal processing of audio signals for the 5.1 channel audio playback systems to be played with binaural effects of space and distance perception to human listeners.

The term "binaural corner impulse response" refers to a method of measurement of impulse response using a room (width 3 meter, length 5 meter, height 3 meter) with a reverberation time of about 450 mini-seconds and placing an artificial human head and a loudspeaker at the diagonal corners of the room.

People are always looking for a good surround sound 3D effect while listening to various types of audio, especially movies, in order for a more immersive experience. This 3D surround effect is typically provided by multi-channel replay system placed around the listener. The most widely used multi-channel replay system is the 5.1 home theatre systems. This system comprises of a bass channel (LFE) and 5 full-band channels wherein left (FL), middle (C), and right (FR) channels are in the front and left surround (LS) and right surround (RS) channels are in the back. Horizontal surround effects can be reproduced by 5.1-channel signals through a properly configured 5.1 system replay. The problem with such multi-channel replay systems are the higher prices and more complex installation. Therefore, people would like to choose a more simple system to achieve the 3D surround effect that they desire.

Currently there is technique of using conventional dual-channel audio systems to replay 5.1-channel signals. Its signal processing is shown in FIG. 1. The process can be summarized as follows: C channel 105 and LFE channel 107 are respectively attenuated by −3 dB (process 113 and 115) and each is then fed to both the left channel 119 and right channel 121 of a dual channel system. FL channel 101 is fed to the left channel 119 and FR channel 103 is fed to the right channel 121 without change, while LS channel 109 and RS channel 111 signals are filtered with HRTF filtering process 117 before being fed to the left channel 119 and right channel 121 respectively for down-mixing. After down-mixing process the left output signal L' 123 and the right output signal R' 125 are binaural audio signals that render the effects of 5.1 audio channels with space and distance perception.

Figure 2:
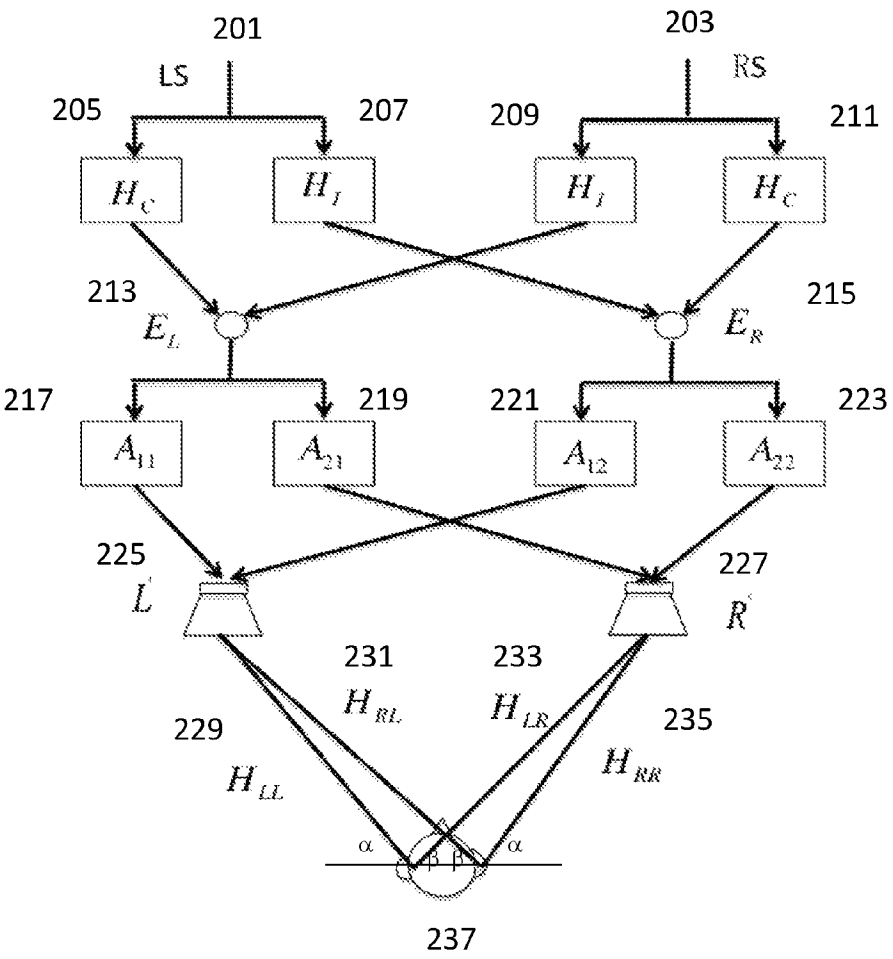
FIG. 2 depicts the general method of binaural audio signal processing in traditional down-mixing 5.1 channel audio signals shown in FIG. 1.

FIG. 2 figuratively illustrates the conventional binaural rendering process 117 of HRTF filtering. In a standard conventional HRTF filtering, LS channel signals 201 and right channel signals 203 are first respectively treated as a virtual sound source from a defined location away from head 237. LS channel signals 201 are then filtered with a pair of HRTFs $H_C$ 205 and $H_I$ 207 and RS channel signals 203 are also filtered with a pair of HRTFs $H_C$ 211 and $H_I$209. The output of $H_C$ filtered LS signal 201 and the output of $H_I$ filtered RS channel signals 203 are then summed up to form left channel $E_L$ 213. The output of $H_I$ filtered LS signal 201 and the output of $H_C$ filtered RS channel signal 203 are then summed up to form left channel $E_R$ 215.

$$\begin{bmatrix} E_L \\ E_R \end{bmatrix} = \begin{bmatrix} H_C & H_I \\ H_I & H_C \end{bmatrix} \begin{bmatrix} L \\ R \end{bmatrix} \tag{1}$$

$E_L$ 213 and $E_R$ 215 signals are further processed for signal crosstalk cancellation with matrix elements $A_{11}$, $A_{21}$, $A_{12}$, $A_{22}$ at step 217, 219, 221 and 223.

The output signals (L' and R') are summed up at steps 225 and 227 to be the source audios for left and right ear respectively. The related HRTFs from L' and R' to head 237 are $H_{LL}$, $H_{RL}$, $H_{LR}$, $H_{RR}$.

$$\begin{bmatrix} L' \\ R' \end{bmatrix} = \begin{bmatrix} A_{11} & A_{12} \\ A_{21} & A_{22} \end{bmatrix} \begin{bmatrix} E_L \\ E_R \end{bmatrix} \tag{2}$$

If treating L' and R' as a speaker sound source from a virtually defined location with angles of $\alpha$ and $\beta$ to the head, the theoretically sound pressure at the left ear and the right ear of human head 237 is as follows:

$$\begin{bmatrix} P_L \\ P_R \end{bmatrix} = \begin{bmatrix} H_{LL} & H_{LR} \\ H_{RL} & H_{RR} \end{bmatrix} \begin{bmatrix} L' \\ R' \end{bmatrix} \tag{3}$$

The replay effect of the processed loudspeaker system L' and R' is equivalent to that of the headphones, $H_{LL}$, $H_{RL}$, $H_{LR}$, $H_{RR}$ represent sound source L' and R' transmitting from their virtual positions to the left and right ear with angles of $\alpha$ and $\beta$.

The HRTF data used above are usually derived from experimental measurements, which often include the following two processes: Measurements are made in an anechoic chamber with no reflected sound; measurements are made by an artificial head instead of real people.

For listeners, there is a difference between the size and shape of the head and torso of the listener and the artificial head. The above two points at least will adversely affect the binaural signals of virtual sound source generated during signal processing step 117, thus impairing the spatial surround effect.

In addition, during replay, there are two ways for adding the subwoofer channel, one is to use an actual subwoofer of a 5.1 system, the other is to directly feed the subwoofer signals to the two main channels for replay. For the latter case, the general dual-channel sound system cannot replay as a strong bass as a subwoofer does and the bass effect would be significantly weakened. Also there may be significant interference due to the fact of mixing 5 or 6 audio signals into two channels, the signals between channels may mask or interfere with each other.

Figure 3:
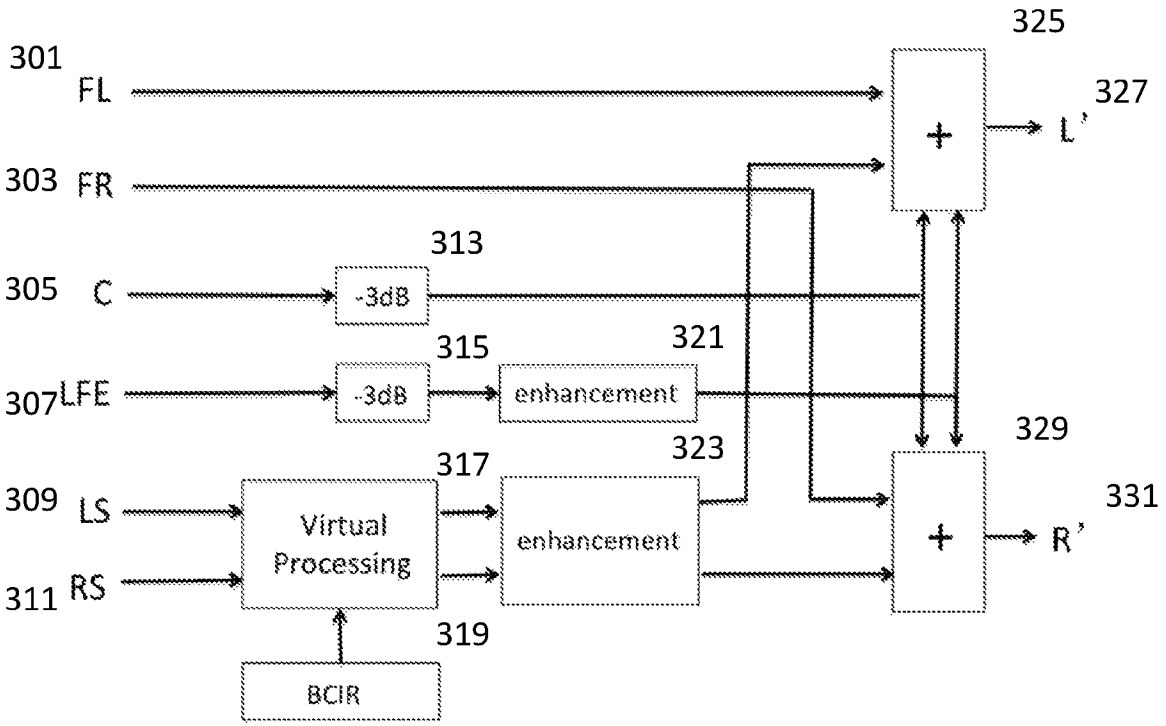
FIG. 3 illustrates an example improved process of down mixing 5.1 channel audio signals into binaural audio signals for two channel play backs in accordance with this application.

To address the above described problems in down-mixing multichannel audio signals for binaural replays, an improved down-mixing process and virtual signal processing is described in FIG. 3 to improve bass and surround sound effect as well as the spatial and distance perception.

Instead of −3 dB signal attenuation, bass channel LFE 307 signals are treated with −3 dB dynamic range compression (DRC) processing 315 and 321 before being fed to the left 327 and right channel 331 for down-mixing to improve bass effect. The traditional −3 dB magnitude attenuation is omitted to enhance the amplitude of the bass. The −3 dB DRC unit avoids distortion of the bass signals or the interferences of other channels due to excessive bass signal amplitude.

After a crosstalk cancellation processing, instead of traditional HRTF filtering, BCIR data is used for BRTF filters 317 and 319 to process LS 309 and RS 311 to generate binaural signals of virtual source from the left and right rears for replay.

In addition, LS channel 309 and RS channel 311 signals are boosted by +3 dB at step 323, and before being fed to the left 327 and right channel 331, they are again processed through a −3 dB DRC unit to reduce the impact of being masked or disturbed by other channels.

Figure 4:
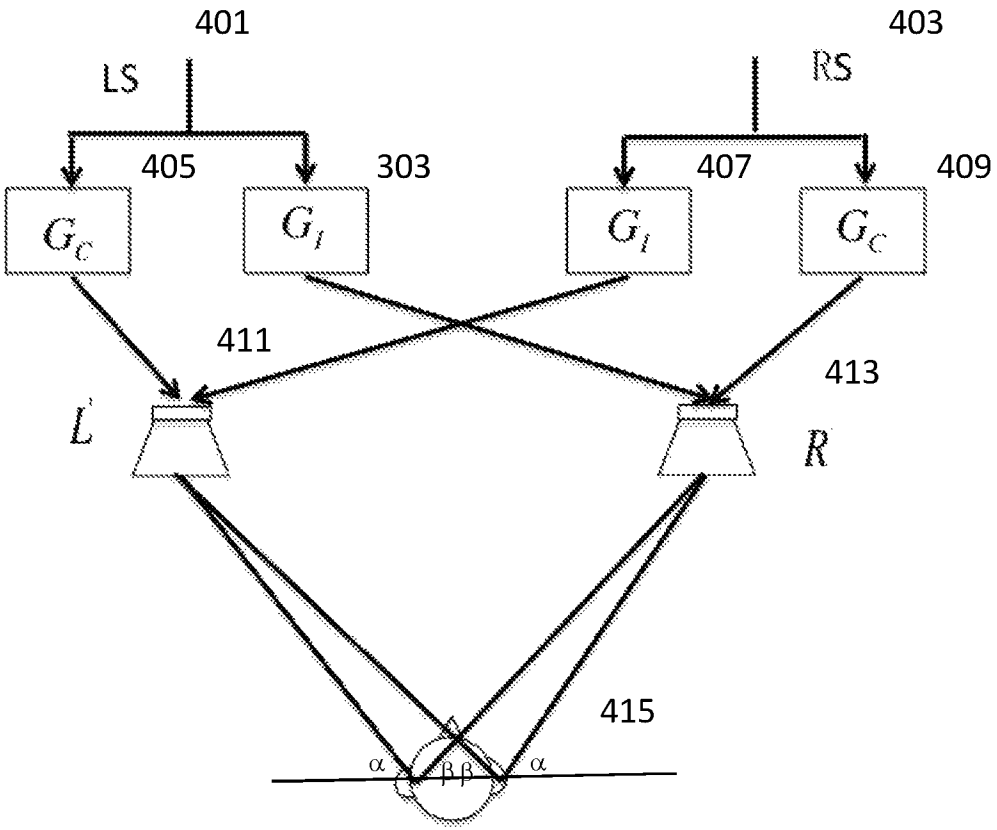
FIG. 4 depicts an example method of binaural audio signal processing in an example down-mixing 5.1 channel audio signals shown in FIG. 3 in accordance with this application.

The signal processing of BRTFs 317 and 319 are demonstrated in FIG. 4. $G_C$ and $G_I$ represent elements after combining crosstalk cancellation and binaural effect filtering. Respectively treated as a virtual sound source from a defined location, LS channel signals 401 are filtered with a pair of BRTFs $G_C$ 405 and $G_I$ 417 and RS channel signals 403 are filtered with a pair of BRTFs $G_C$ 409 and $G_I$ 407. The output of $G_C$ filtered LS signal 401 and the output of $G_I$ filtered RS channel signals 403 are summed up to form left sound source L'. The output of $G_I$ filtered LS signal 401 and the output of $G_C$ filtered RS channel signals 403 are summed up to form right sound source R', in which the transfer functions $CH_C$ and $CH_I$ are obtained by FFT conversion of the measured BCIR data, therefore the $H_C$ and $H_I$ in equation (1) are substituted with $CH_C$ and $CH_I$ and the resulting signals:

$$\begin{bmatrix} E_L \\ E_R \end{bmatrix} = \begin{bmatrix} CH_C & CH_I \\ CH_I & CH_C \end{bmatrix} \begin{bmatrix} L \\ R \end{bmatrix} \tag{4}$$

After crosstalk cancellation processing with matrix elements:

$$\begin{bmatrix} L' \\ R' \end{bmatrix} = \begin{bmatrix} A_{11} & A_{12} \\ A_{21} & A_{22} \end{bmatrix} \begin{bmatrix} E_L \\ E_R \end{bmatrix} \tag{5}$$

Feeding L' and R' to the left and right loudspeakers at a virtual location with α and β angles to the head for binaural replay and stereo sound effect, the physical transfer from the speakers to the ears of the listener can be expressed mathematically as:

$$\begin{bmatrix} P_L \\ P_R \end{bmatrix} = \begin{bmatrix} H_{LL} & H_{LR} \\ H_{RL} & H_{RR} \end{bmatrix} \begin{bmatrix} L' \\ R' \end{bmatrix} \tag{6}$$

$G_C$ and $G_I$ are then derived from the following relations through mathematical operations:

$$\begin{bmatrix} L' \\ R' \end{bmatrix} = \begin{bmatrix} G_C & G_I \\ G_I & G_C \end{bmatrix} \begin{bmatrix} L \\ R \end{bmatrix} \tag{7}$$

Based on the above four equations and let $\alpha=H_{LL}=H_{RR}$, $\beta=H_{LR}=H_{RL}$ according to the spherical coordinate symmetry positions of head being in the middle wherein α, β represent spherical positions of the head relative to the virtual sound source L' and R', the following equations can be obtained:

$$G_C = \frac{\alpha CH_C - \beta CH_I}{\alpha^2 - \beta^2} \tag{8}$$

$$G_I = \frac{\alpha CH_I - \beta CH_C}{\alpha^2 - \beta^2} \tag{9}$$

Therefore the resulting signals of the process of FIG. 4 can be represented by the following mathematical expression:

$$L'=L+0.707C+\nabla(LFE)+\nabla[1.414(G_C LS+G_I RS)] \tag{10}$$

$$R'=R+0.707C+\nabla(LFE)+\nabla[1.1414(G_I LS+G_C RS)] \tag{11}$$

Wherein, L' and R' represent the left and right channel signals that are ultimately fed to the targeted dual-channel sound system. The operator ∇ represents the DRC process of −3 dB. $G_C$ and $G_I$ represent the process of combining crosstalk cancellation and generating binaural signals of a virtual sound source. In the mathematical formulas, 0.707 represents the attenuation of −3 dB and 1.414 represents enhancement of +3 dB in signal magnitude.

Figure 5:
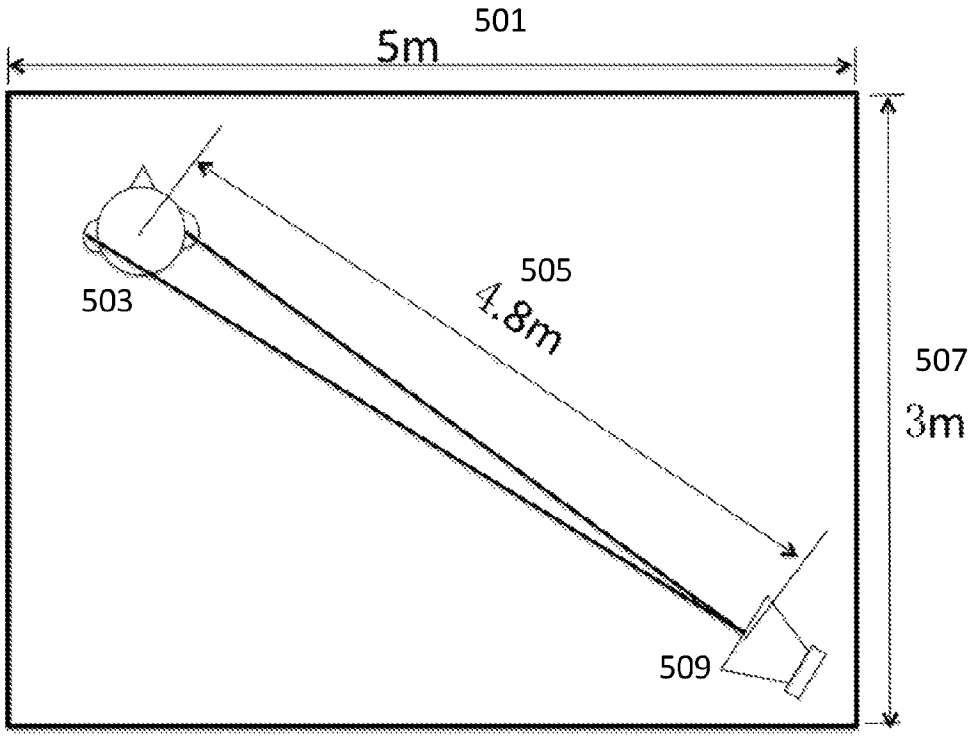
FIG. 5 figuratively depicts the measurement room setting for measuring BCIR data in accordance with this application.

In reference to FIG. 5, BCIR data is obtained by using a high-quality HIFI speaker 509 and artificial head 503 around 4.8 meters in distance 505 from each other to measure impulse responses within a 5 meters length 501 by 3 meters width 507 room and by 3 meter height with a reverberation time of about 450 mini-seconds. During the measurement, the loudspeaker and the microphone are placed at the opposite corners of the room in order to obtain a better sense of spatial hearing and make subsequent signal processing easier. The good sound quality of this room was verified by about several audio sound experts in test hearing.

As mentioned, the HRTF data measured in the anechoic chamber using the artificial head can distort the direction of the resulting virtual sound source and seriously affect the surround sound 3D effect. Many studies have pointed out that the reflected sound in the environment plays a very important role in the localization of the sound source. In fact, a regular listener with normal hearing can clearly perceive this. The sensed sound source position in the anechoic chamber is significantly closer to the listener than the position in the normal room. That is to say, the absence of reflected sound compromises the perception of spatial location. Therefore, this invention uses the BRIR data, including the reflected sound, to perform the data processing when the binaural signals of virtual sound source are generated.

The problem with the use of BRIR data, which includes reflected sounds, is that the signal processing becomes more complex. First of all, the presence of reflected sounds greatly increases the length of the impulse response, especially when measuring impulse response data in a room with long reverberation time, making it very difficult to design the filter. The number of generated filter taps is too large for the common DSP to be able to handle. For HRTF filters, the energy of the HRTF data measured in the anechoic chamber is almost concentrated in the first 128 data points. Because the actual measured data is firstly a binaural impulse response that does not contain reflected sounds, the process usually lasts about only 2.67 mini-seconds at a sampling frequency of 48 kHz and it only requires 128 taps to design a filter of very acceptably small error. But for the typical home environment, the reverberation time can be as long as hundreds of milliseconds, common DSP chips are incapable of handling so many data points.

To solve this problem, the first approach taken in this invention selects the measurement environment in a relatively small room having a width of about 3 meter, a length of about 5 meter, a height of about 3 meter, and a reverberation time of about 450 mini-seconds. A number of experienced audio practitioners' auditions showed that listeners were able to hear a good sense of space with the loudspeaker in the room playing a variety of audio sources.

Figure 6:
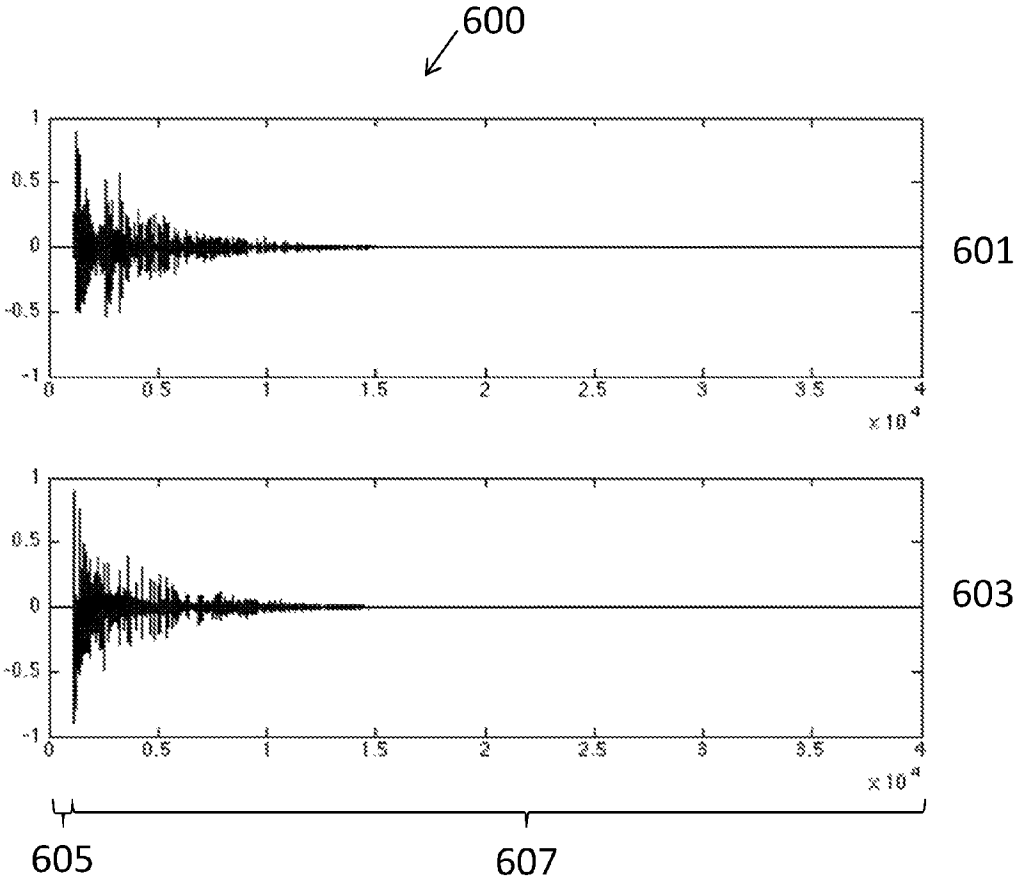
FIG. 6 shows example graphs of measured impulse responses in accordance with this application.
Figure 7:
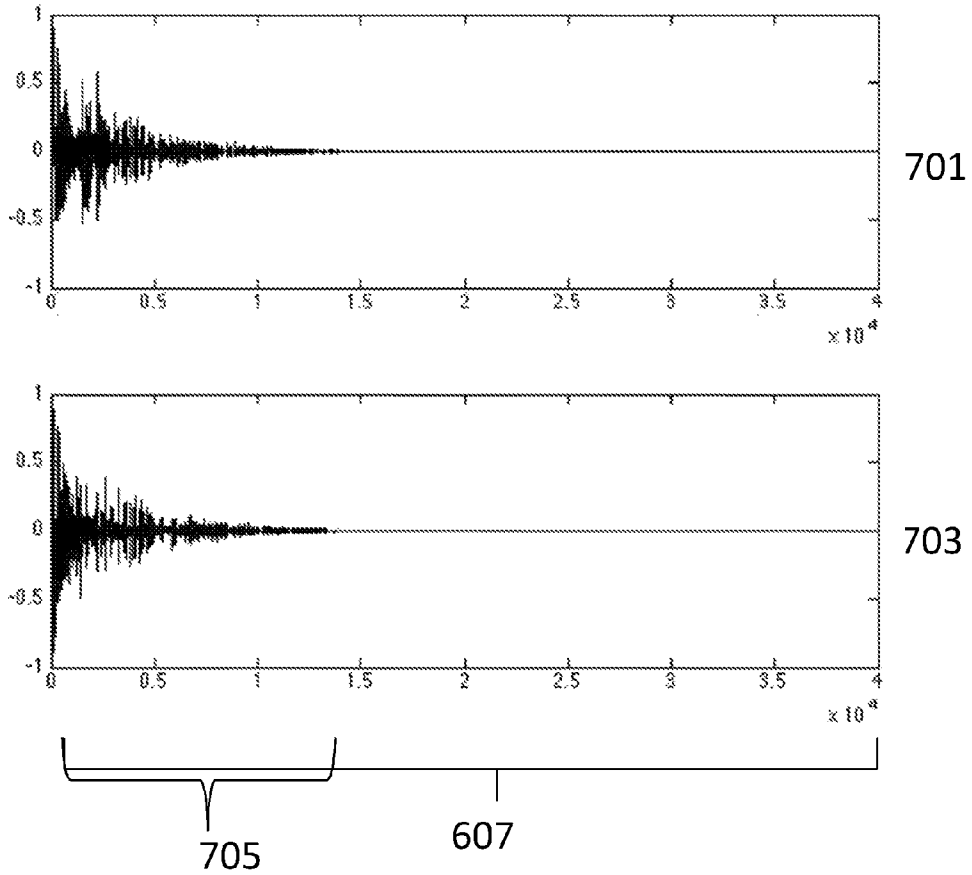
FIG. 7 shows the data graphs of the measured impulse responses of FIG. 6 with the initial cut off time window in accordance with this application.
Figure 8:
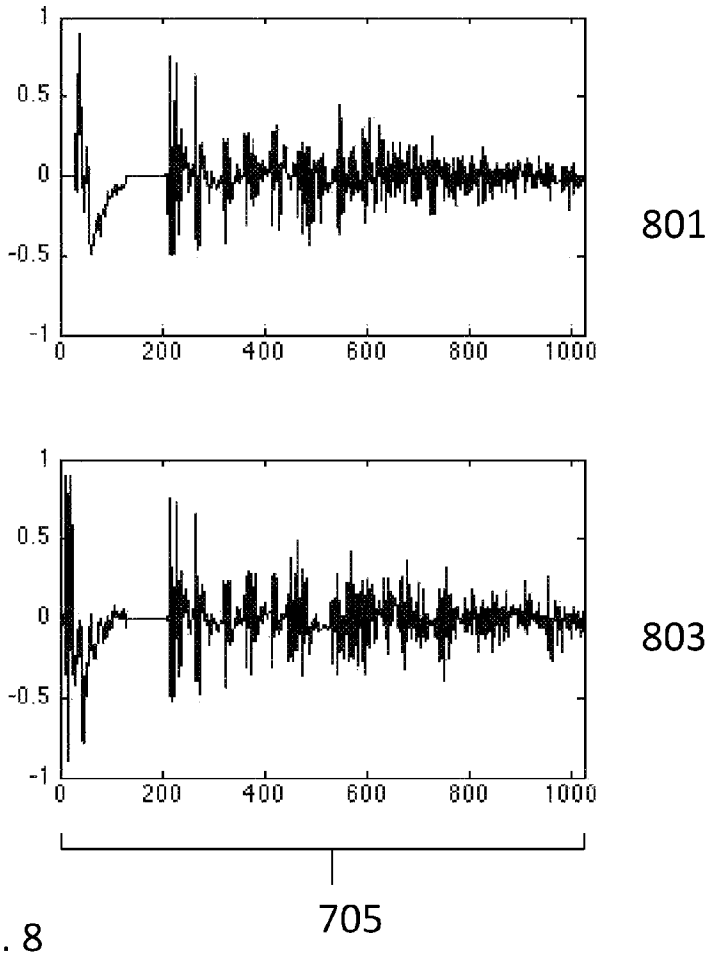
FIG. 8 shows example graphs of collecting 1020 impulse response data points of FIG. 7 in accordance with this application.

In reference to FIG. 6, an example left ear 601 and right ear 603 impulse response are shown. The time for the direct sound to reach the artificial head from the loudspeaker is about 14.1 mini-seconds 605 before there is impulse response time 607. In this instance the silent time 605 is then removed (FIG. 7) to generate left ear graph 701 and right ear graph 703. By placing the loudspeaker 509 in a corner position during the measurement and place the artificial head in the opposite corner, it allows the early reflected sounds to be denser, increasing the number of reflected sound in the initial 1024 data points 705. In a room of a size of 3 m by 5 m by 3 m, and measuring from corners, these 1024 data points contain both primary and secondary reflected sounds, allowing for cutting off the remaining section of 607, as shown in FIG. 8. Numeral reference 801 represents measured impulse data from left ear and numeral reference 803 represents measured impulse data from right ear.

After the BCIR data was obtained, the Fourier transform can be carried out to obtain the corresponding transfer function $CH_C$ and $CH_I$ in equation (4) and then obtain $G_C$ and $G_I$ according to equations (8) and (9). In this process, the calculated $G_C$ and $G_I$ may need cycle delay processing so that it represents the causal system, and appropriate smoothing to reduce the length of the impulse response data obtained through inverse Fourier transform.

By the above approach, a BRTFs filter of IIR (infinite impulse response) digital filter structure may be constructed with Prony method (a well known method in the field) at a power (128,128). As an implementation example, the entire signal process was carried out using ADAU1701 DSP chip of the ADI Corporation.

Figure 9:
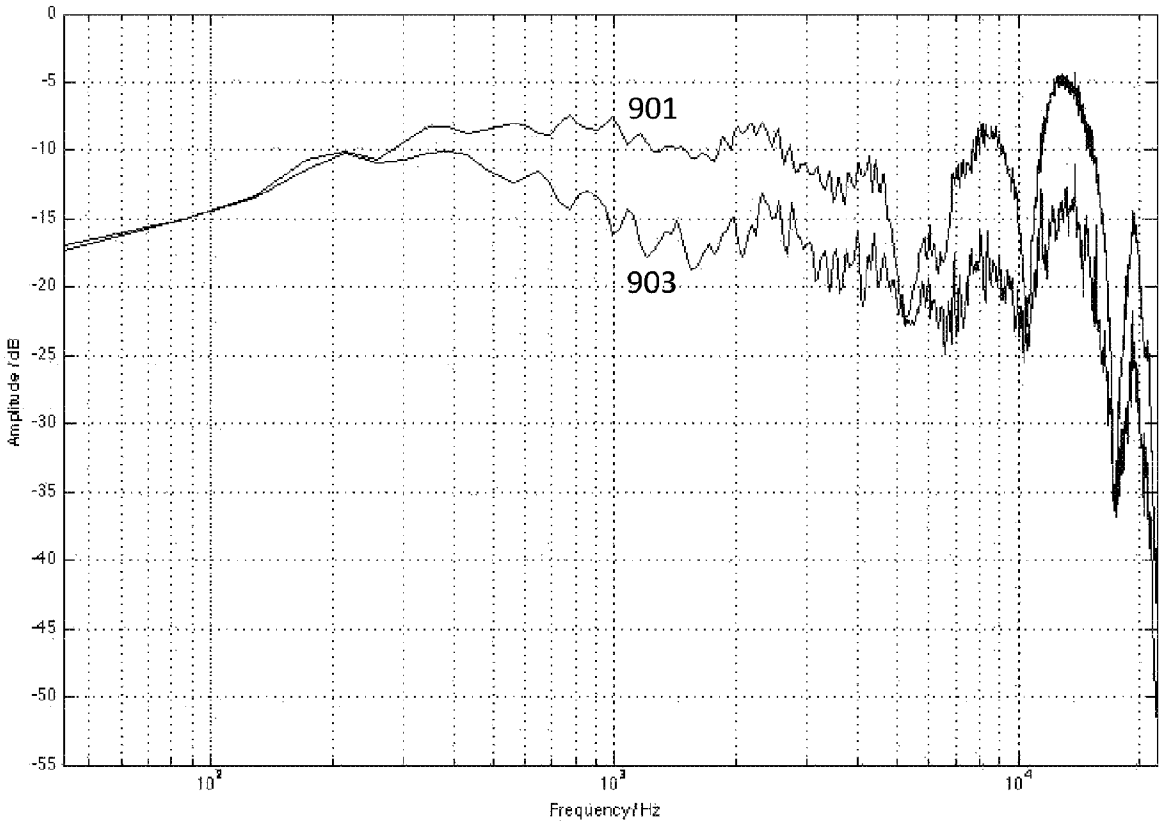
FIG. 9 shows an example contrast of the output audio signals at the left ear channel and the output audio signals at the right ear channel after applying the BRTF filter built thereof in accordance with this application.

In reference to FIG. 9, example filtered binaural audio signals are generated for the left ear (901) and for the right ear (903) using a BRTFs filter of IIR filter as described above constructed with ADAU1701 DSP chips.

None of the descriptions in the present application should be read as implying that any particular element, step, or function is an essential element which must be included in the claim scope: THE SCOPE OF PATENTED SUBJECT MATTER IS DEFINED ONLY BY THE ALLOWED CLAIMS. Moreover, none of these claims are intended to invoke paragraph six of 35 USC section 112 unless the exact words "means for" are followed by a participle. The claims as filed are intended to be as comprehensive as possible, and NO subject matter is intentionally relinquished, dedicated, or abandoned.

What is claimed is:

1. A method for down-mixing audio signals from a 5.1-channel input having a channel L, a channel R, a channel C, a channel LFE, a channel LS and a channel RS, comprising the steps of:

about a −3 dB DRC (dynamic range compression) processing of the LFE channel signals using a DRC circuit before mixing, about a respectively +3 dB boosting of the LS and the RS channel signals using an amplifying circuit; and then about a −3 dB DRC processing respectively of the boosted LS and RS channel signals using a DRC circuit.

2. The method of claim 1, further comprising the step of:

binaural filtering the LS and the RS channel signals using a BRTF (binaural room transfer function) filter designed with a set of BCIR (binaural corner impulse response) data.

3. The method of claim 2, wherein said BCIR data are collected in a 5 m×3 m×3 m room setting by placing a loud HIFI speaker at one corner and placing an artificial head at a diagonal corner to the HIFI speaker, wherein said HIFI loud speaker and said artificial head are about 4.8 meter apart.

4. The method of claim 3, wherein said BRTF filter is constructed with BCIR data collected after a less than 14.1 mini-seconds cutoff time window.

5. The method of claim 4, wherein said BCIR data comprises 1024 tap points.

6. The method claim 5, wherein said BRTF filter is designed using Prony method and DSP chip.

7. A method for down-mixing audio signals from a 5.1-channel input having a channel L, a channel R, a channel C, a channel LFE, a channel LS and a channel RS, comprising the steps of:

down-mixing said audio signals from each of respective 5.1 channels, outputting a left channel L' audio signal and a right channel R' audio signal wherein said L' and R' audio signals are defined by a formula as follows:

$$L'=L+0.707C+\nabla(LFE)+\nabla[1.414(G_C LS+G_I RS)]$$

$$R'=R+0.707C+\nabla(LFE)+\nabla[1.1414(G_I LS+G_C RS)]$$

wherein operator ∇ represents a −3 dB DRC processing, $G_C$ and $G_I$ respectively represents a combined result of a process of crosstalk cancellation and a process of generating binaural signals, 0.707 represents a attenuation of −3 dB in signal magnitude, 1.414 represents an enhancement of +3 dB in signal magnitude, L, R, C, LFE, LS, and RS respectively represents signal magnitude of each respective corresponding channel.

8. The method of claim 7, wherein $$G_C = \frac{\alpha CH_C - \beta CH_I}{\alpha^2 - \beta^2};$$

and $$G_I = \frac{\alpha CH_I - \beta CH_C}{\alpha^2 - \beta^2}.$$

wherein $CH_C$ and $CH_I$ are transfer functions obtained by Fourier transform conversion of a set of BCIR data, α and β respectively represents a virtual position of said left channel L' audio signal and said right channel R' audio signal to a listener's head.

9. The method of claim 8, wherein said BCIR data are measured in a 5 m×3 m×3 m room setting by placing a HIFI speaker at one corner and placing an artificial head at a diagonal corner to the HIFI speaker, wherein said HIFI speaker and said artificial head are about 4.8 meter apart.

10. The method of claim 9, wherein said BCIR data are collected after a less than 14.1 mini-seconds of cutoff time window.

11. The method of claim 10, wherein said BCIR data comprises 1024 tap points.

12. The method of claim 11, wherein a BRTF filter is constructed using said BCIR data using Prony method and DSP chip.

13. A binaural replay system for playing audio signals from a 5.1-channel input having a channel L, a channel R, a channel C, a channel LFE, a channel LS and a channel RS, said system comprising:

an audio compressor unit for a −3 dB DRC processing of the LFE channel signals before mixing;

an amplifier circuit for a respectively +3 dB boosting of the LS and the RS channel signals; and a compressor circuit for a −3 dB DRC processing respectively of the boosted LS and RS channel signals.

14. The binaural replay system of claim 13, said system further comprising: a binaural filter respectively for filtering the LS and the RS channel signals using a BRTF filter designed with a set of BCIR data.

15. The binaural replay system of claim 14, wherein said BCIR data are measured in a 5 m×3 m×3 m room setting by placing a HIFI speaker at one corner and placing an artificial head at a diagonal corner to the HIFI speaker, wherein said HIFI speaker and said artificial head are about 4.8 meter apart.

16. The binaural replay system of claim 15, wherein said BRTF filter is constructed with said BCIR data collected after a less than 14.1 mini-seconds of cutoff time window.

17. The binaural replay system of claim 16, wherein said BCIR data comprising 1024 tap points.

18. The binaural replay system of claim 17, wherein said BRTF filter is designed using Prony method and DSP chip.

19. A binaural replay system for replaying audio signals from a 5.1-channel input having a channel L, a channel R, a channel C, a channel LFE, a channel LS and a channel RS, comprising:

an electronic processing unit for down-mixing said audio signals of respective 5.1 channels, outputting a left channel L' audio signal and a right channel R' audio signal wherein said L' and R' audio signals are defined by a formula as follows:

$$L'=L+0.707C+\nabla(LFE)+\nabla[1.414(G_C LS+G_I RS)]$$

$$R'=R+0.707C+\nabla(LFE)+\nabla[1.1414(G_I LS+G_C RS)]$$

wherein operator ∇ represents a −3 dB DRC processing, $G_C$ and $G_I$ respectively represents a combined result of a crosstalk cancellation process and a process of generating binaural signals, 0.707 and 1.414 respectively represents a attenuation of −3 dB in signal magnitude and an enhancement +3 dB in signal magnitude, L, R, C, LFE, LS, and RS respectively represents signal magnitude of each respective corresponding channel.

20. The binaural replay system of claim 19, wherein $$G_C = \frac{\alpha CH_C - \beta CH_I}{\alpha^2 - \beta^2};$$

and $$G_I = \frac{\alpha CH_I - \beta CH_C}{\alpha^2 - \beta^2}.$$

wherein $CH_C$ and $CH_I$ are transfer functions obtained by Fourier transform conversion of a set of BCIR data, α and β respectively represents a virtual position of said left channel L' audio signal and said right channel R' audio signal to a listener's head.

21. The binaural replay system of claim 20, wherein said BCIR data are measured in a 5 m×3 m×3 m room setting by placing a HIFI speaker at one corner and placing an artificial head at a diagonal corner to the HIFI speaker, wherein said HIFI speaker and said head are about 4.8 meter apart.

22. The binaural replay system of claim 21, wherein said BCIR data are collected after a less than 14.1 mini-seconds of cutoff time window.

23. The binaural replay system of claim 22, wherein said BCIR data comprising 1024 tap points.

24. The binaural replay system of claim 23, wherein a BRTF filter is constructed using said BCIR data using Prony method and DSP chip.

* * * * *